US005203309A

United States Patent [19]

Goto et al.

[11] Patent Number: 5,203,309

[45] Date of Patent: Apr. 20, 1993

[54] INTAKE SYSTEM WITH SUPERCHARGER FOR INTERNAL COMBUSTION ENGINE

[75] Inventors: Tsuyoshi Goto; Kouichi Hatamura, both of Hiroshima, Japan

[73] Assignee: Mazda Motor Corporation, Hiroshima, Japan

[21] Appl. No.: 645,927

[22] Filed: Jan. 25, 1991

[30] Foreign Application Priority Data

Jan. 25, 1990 [JP] Japan ..... 2-15737

[51] Int. Cl.[5] ..... F02B 33/00

[52] U.S. Cl. ..... 123/564

[58] Field of Search ..... 60/600, 601, 611; 123/564

[56] References Cited

U.S. PATENT DOCUMENTS 4,802,456 2/1989 Okane et al. ..... 123/564

5,022,375 6/1991 Goto et al. ..... 123/564

FOREIGN PATENT DOCUMENTS 179127 7/1988 Japan ..... 123/564

183429 11/1988 Japan ..... 123/564

272919 11/1988 Japan ..... 123/564

*Primary Examiner*—Michael Koczo

*Attorney, Agent, or Firm*—Keck, Mahin & Cate

[57] ABSTRACT

An intake system has an intake passage provided with a throttle valve and a supercharger for delivering a supercharger pressure to intake air engine cylinders. A bypass passage is connected to the intake passage so as to allow an intake air flow to bypass the supercharger. The intake air flow in the bypass passage is controlled by a valve, disposed in the bypass passage, which operates to variably cause the intake air to flow in the bypass passage only with a negative pressure created in the intake passage upstream of the supercharger. A pressure is applied to the valve during closing so as to cancel the supercharger pressure acting on the valve in an opening direction.

10 Claims, 6 Drawing Sheets

INTAKE SYSTEM WITH SUPERCHARGER FOR INTERNAL COMBUSTION ENGINE

The present invention relates to an intake system with a supercharger for an internal combustion engine and, more particularly, to an intake system having a bypass passage with a control valve bypassing a supercharger.

BACKGROUND OF THE INVENTION

1. Field of the Invention

An internal combustion engine has been provided with improved charging efficiency by the use of a supercharger, such as a mechanical supercharger, usually driven from the engine crankshaft through belts, gears or chains, together with a turbocharger, driven by exhaust gases of the engine.

Such a supercharger improves charging efficiency and raises engine output power. However, such a supercharger also has a disadvantage in that it increases the intake flow resistance of intake air when the engine operates at lower or lighter loads, when it is not required to provide high output power. Increasing the intake flow resistance causes a loss in engine output power and a decrease in fuel economy.

2. Description of Related Art

To reduce the intake flow resistance of intake air or the driving loss of an engine, it is typical, as is known from, for instance, Japanese Unexamined Utility Model Publication No. 61-17141, to provide the intake system with a bypass passage with a control valve bypassing a supercharger. The control valve is actuated to open the bypass passage at lower or lighter engine loads so as to decrease the intake flow resistance of intake air in an intake passage. Typically, such a control valve is operated by an actuator, such as a negative pressure-operated diaphragm type actuator, operated with negative pressure created by the intake air in the intake passage downstream of a throttle valve, so as to open the bypass passage at lower or lighter engine loads where the negative pressure is high, and to close the bypass passage at higher or heavier engine loads where the negative pressure is low.

In such an intake system, supercharger pressure generated by the supercharger forces the control valve to open. In order to keep the control valve closed with certainty when the engine operates at higher or heavier loads, where the negative pressure is high, a compression spring, cooperating with the diaphragm, must strongly urge the control valve. If a strong spring in the actuator is used, it is required for the diaphragm to have a large actual pressure receiving surface area, resulting in a large actuator size. Furthermore, a strong spring forces the control valve to close earlier than usual upon the occurrence of a slight drop in negative pressure while the control closes the bypass passage with an increase in engine load. This leads to closing of the bypass passage unnecessarily, or more than necessary, at medium or moderate loads, and thereby to a useless increase in load on and driving loss of the supercharger.

Due to the fact that a control valve which receives supercharger pressure in a direction in which it opens exhibits such unstable behavior as closing the bypass passage again because of a drop in supercharger pressure after opening, so as to cause a rise in supercharger pressure, and the fact that a change in supercharger pressure is different, depending on valve openings, it is difficult to adjust and regulate precisely the supercharger pressure to desired levels.

SUMMARY OF THE INVENTION

A primary object of the present invention is to provide an intake system for an internal combustion engine with a supercharger which realizes the use of valve means having a small size.

Another object of the present invention is to provide an intake system for an internal combustion engine with a supercharger which controls precisely the supercharger pressure of intake air with improved speed of response to the motion of throttle valve.

Still another object of the present invention is to provide an intake system for an internal combustion engine with a supercharger which causes a decrease in working loss of the supercharger.

These objects are achieved by providing an intake system including an intake passage provided with at least a throttle valve and a supercharger, in order, from an upstream side of the intake passage for delivering a controlled supercharger pressure of intake air created by the supercharger into cylinders of an internal combustion engine. A bypass passage branches off from the intake passage between the throttle valve and the supercharger and is connected to the intake passage downstream of the supercharger so as to allow intake air to flow therein, bypassing the supercharger. Pressure controlled valve means is disposed in the bypass passage and is operated so as to cause and shut down the intake air flow in the bypass passage. The pressure controlled valve means applies, in one direction, the supercharged pressure in the intake passage downstream of the supercharger, and a negative pressure created by the intake air in the intake passage between the throttle valve and the supercharger to the valve, so as to cause a movement in the one direction for allowing the intake air flow. The pressure controlled valve means also applies, in another direction, opposite to the one direction, a pressure, substantially equal to the supercharger pressure, to the valve so as to cause another movement in the other direction for shutting down the intake air flow.

Specifically, the pressure controlled valve means comprises a valve assembly and pressure operated valve actuator means operationally coupled to the valve assembly. The valve assembly comprises a valve and a valve housing, forming therein a pressure chamber and supporting the valve for reciprocal movement. The valve housing has an inlet port for introducing the negative pressure in the pressure chamber so as to apply it to the valve in the one direction and an outlet port for introducing the supercharger pressure so as to apply it to the valve in the one direction. The pressure operated valve actuator means includes an actuator housing secured to the valve housing and forming therein an actuator pressure chamber in communication with the outlet port, and diaphragm means disposed in the actuator housing and operationally coupled to the valve so as to apply the pressure to the valve in the other direction.

When the engine operates at lower or lighter loads, where a negative pressure created by the intake air flow in the intake passage upstream of the supercharger is high, the valve is operated to move away from the outlet port, so as to allow the intake air to flow in the bypass passage bypassing the supercharger and thereby to cause a decrease in supercharger pressure. When the engine operates at higher or heavier loads, where a negative pressure created by the intake air flow in the intake passage upstream of the supercharger is low, the valve is operated to move closer to the outlet port, so as to throttle the intake air into the bypass passage and thereby to cause an increase in supercharger pressure.

The valve moves in opposite directions according to the negative pressure created in the intake passage upstream of the supercharger so as to regulate the intake air flow in the bypass passage, thereby controlling the supercharger pressure of intake air, depending only upon the negative pressure. This allows installation, in the pressure operated actuator means, a weak and small spring, so that the pressure controlled valve means can be made small in size and so that the valve operates precisely, with improved speed of response to the motion of throttle valve. Also, a decrease in working loss is caused.

BRIEF DESCRIPTION OF THE DRAWINGS

The above and other objects and features of the present invention will be apparent from the following description of preferred embodiments thereof when considered together with the accompanying drawings. Similar reference numbers have been used to designate the same or similar elements throughout the drawings, in which.

DETAILED DESCRIPTION OF THE PREFERRED EMBODIMENTS

Because, in general, an internal combustion engine with a mechanical supercharger with which an intake system in accordance with the present invention is used is well known to those skilled in the art, the following description is directed to particular elements forming part of, or cooperating with, the novel structure of the intake system in accordance with the present invention. It is to be understood that elements not specifically shown or described can take various forms well known to those skilled in the art.

Figure 1:
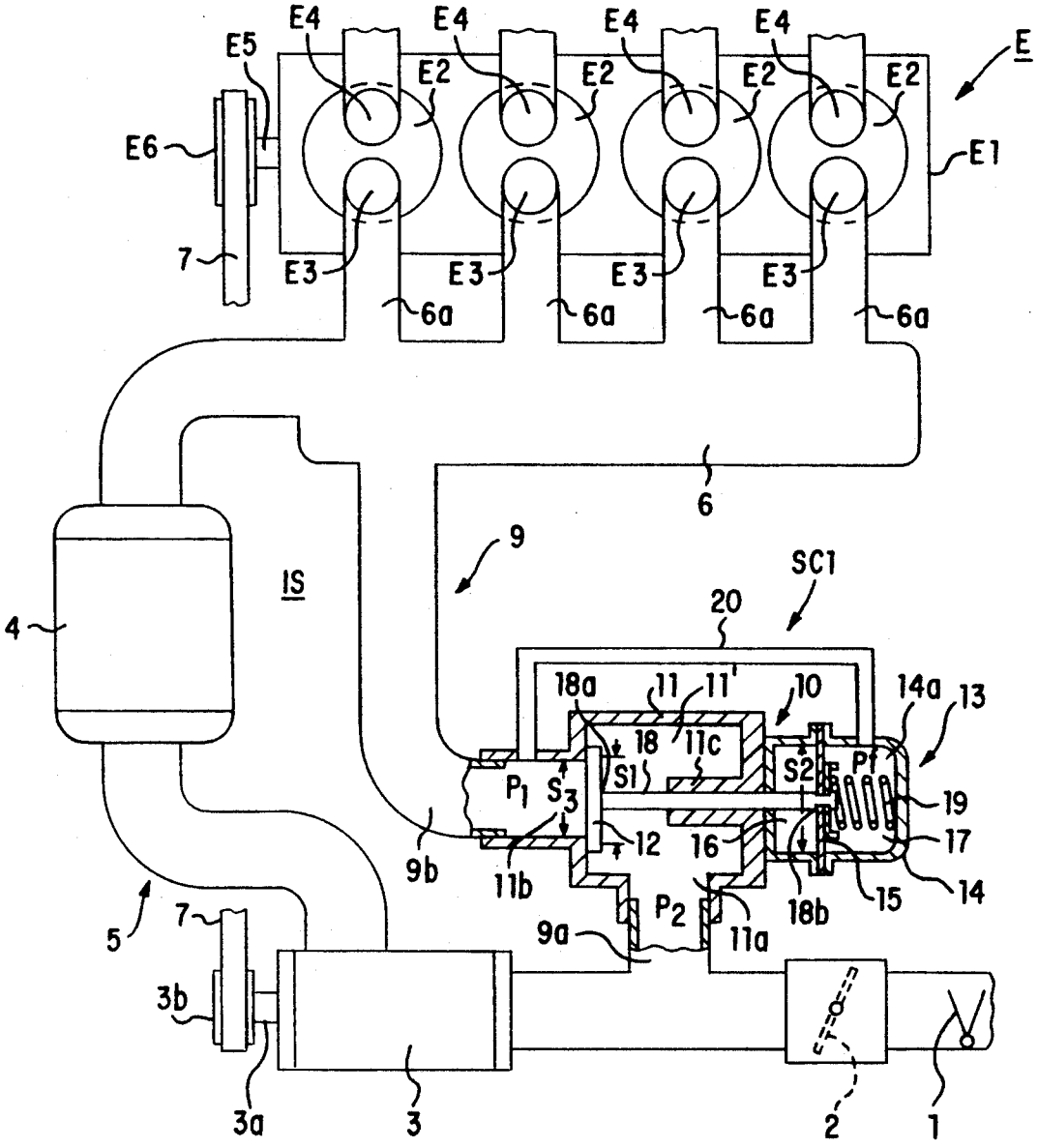
FIG. 1 is a schematic illustration showing an intake system in accordance with a preferred embodiment of the present invention.

Referring to the drawings, and in particular to FIG. 1, details of an intake system according to a preferred embodiment of the present invention, used with an internal combustion engine with a compressor supercharger, generally designated by a reference character E, is illustrated schematically. The engine E is, for instance, an in-line, four-cylinder, internal combustion type, and has an engine block E1 formed with first to fourth cylinders E2. Intake and exhaust ports E3 and E4 open into each cylinder E2 and are opened and shut at a predetermined timing by intake and exhaust valves (not shown), respectively.

Intake air is introduced into the cylinders E2 through an intake system, generally designated by reference characters IS, having an intake passage, such as an intake pipe 5, and a surge tank 6. The intake ports E3 for the respective cylinders E2 in the engine block E1 are separately communicated with the surge tank 6 by way of discrete pipes **6*a* which are short in length. The intake pipe 5 is provided with, from its upstream side, an upstream positioned air cleaner (not shown), an airflow meter 1, a throttle valve 2, a supercharger 3, such as a compressor type supercharger, and an inter-cooler 4**, all of which may be of types well known in structure and operation in the art.

The longitudinal axis of the supercharger 3 is parallel to the crankshaft E5 of the engine E. A pulley **3*b* coaxially mounted on a drive shaft 3*a* of the supercharger 3 is operationally coupled to a pulley E6 coaxially mounted on the crankshaft E5 of the engine E by a belt 7, which transmits the engine output to drive the pulley 3*b* of the supercharger 3**.

A bypass passage, such as a bypass pipe 9 which bypasses the supercharger 3 and the inter-cooler 4, is provided with pneumatic, or pressure controlled, valve means SC1. The bypass pipe 9 is divided into two segments, i.e., first or upstream and second or downstream bypass pipe segments **9*a* and 9*b*, on upstream and downstream sides of the pneumatic valve means SC1. The pneumatic valve means SC1 comprises a pneumatic, or pressure controlled, valve assembly 10 and actuator means, such as a pneumatic, or pressure operated, actuator 13, disposed between the two bypass pipe segments 9*a* and 9*b*. The upstream pipe segment 9*a* connects the pneumatic valve assembly 10 to the intake pipe 5 between the throttle valve 2 and the supercharger 3, and the downstream pipe segment 9*b* connects the pneumatic valve assembly 10 to the surge tank 6**.

Pneumatic valve assembly 10 comprises a rectangular parallelepiped or cylindrical valve housing 11, forming therein a pressure chamber 11' and having an upstream or inlet port **11*a* and a downstream or outlet port 11*b*, with their longitudinal center axes intersecting each other at a right angle, and a mount 11*c*, extending toward the outlet port 11*b*. A valve stem 18, with its one end 18*a* connected to a valve body 12 located inside the valve housing 11 and its other end 18*b* projecting outside the valve housing 11, is slidably supported by the mount 11*c* for axial movement so that the valve body 12 can move away from and closer to the outlet port 11*b* of the housing, to thereby connect and disconnect the upstream and downstream pipe segments 9*a* and 9*b* of the bypass pipe 9**.

Pneumatic actuator 13, which is attached to the valve housing 11 of the pneumatic valve assembly 10, comprises a rectangular parallelepiped or cylindrical actuator housing 14, forming therein a pressure chamber **14*a* and receiving therein the other end 18*b* of the valve stem 18, a restorable diaphragm 15 coupled to the other end 18*b* of the valve stem 18, and a coil spring 19 or, 19 disposed so as to urge the restorable diaphragm 15 toward the pneumatic valve assembly 10. The restorable diaphragm 15 divides the pressure chamber 14*a* formed in the actuator housing 14 into two chambers, i.e., first and second pressure chambers 16 and 17, airtightly isolated from each other. As shown in FIG. 3B, the coil spring 19'** is placed in the first pressure chamber 16 if it is an expanded tension spring, while a coil spring 19 is placed in the second pressure chamber 17, as shown in FIG. 3H, if it is a compression spring. Referring again to FIG. 1, the restorable diaphragm 15 has a pressure receiving area S2 as large as a pressure receiving area S1 of the valve body 12 which is at least equal to a cross-sectional area S3 of the outlet port 11*b*. The second pressure chamber 17 communicates with the downstream port 11*b* by way of a communication pipe 20 so as to introduce therein the pressure in the outlet port 11*b*. Accordingly, the restorable diaphragm 15 receives an axial force equivalent to the difference between the pressure in the downstream port 11*b* and the sum of the spring force of the compression spring 19 and the pressure in the second pressure chamber 17 which act on the restorable diaphragm 15 in opposite directions.

When the engine E operates, the supercharger 3 is driven to introduce intake air therein through the air cleaner and the throttle valve 2 and compresses the intake air. The compressed intake air is delivered into the cylinders E2 through the intercooler 4, the surge tank 6, and the respective discrete pipes 6*a* in their intake cycles, respectively.

Supercharger pressure P1, applied into the surge tank 6, is partly introduced into the outlet port 11*b* of the pneumatic valve assembly 10 through the downstream pipe segment 9*b* of the bypass pipe 9, and acts on the valve body 12 in the direction in which the valve body 12 opens the downstream port 11*b*, or the opening direction. Negative pressure P2 is created by the intake air in the intake pipe 5 downstream of the throttle valve 2, and is introduced into the pressure chamber 11' of the pneumatic valve assembly 10 through the upstream pipe segment 9*a* of the bypass pipe 9 so as to act on the valve body 12. The valve body 12 is forced by not only the supercharger pressure P1, but also the negative pressure P2, in the opening direction.

On the other hand, the valve body 12 is urged in the closing direction by the compression coil spring 19 placed in the second pressure chamber 17 of the pneumatic actuator 13, through the restorable diaphragm 15 and the valve stem 18 and a pressure P1', introduced into the second pressure chamber 17 from the outlet port 11*b* of the pneumatic valve assembly 10 through the communication pipe 20, which is usually equal to the supercharger pressure P1. Because of the fact that the valve body 12 has the same pressure receiving area as the pressure receiving area S2 of the restorable diaphragm 15, the pressures P1 and P1', acting on the valve body 12 in the opposite direction, are cancelled, so that the valve body 12 is forced by and according to the difference between the compression force of the spring 19 acting on the valve body 12 in the closing direction, and by the negative pressure P2 in the pressure chamber 11*a* of the pneumatic valve assembly 10 acting on the valve body 12 in the opening direction, to open or close the outlet port 11*b*, and hence, the bypass passage 9.

When the engine E operates in a range of lower or lighter loads, where the throttle valve 3 is in the idle position, or closed position, or in smaller opening positions, and develops a higher negative pressure P2 in the pressure chamber 11' of the pneumatic valve assembly 10, the valve body 12 of the pneumatic valve assembly 10 is forced by the negative pressure P2 against the compression coil spring 19 to open the outlet port 11*b*, so as to open the bypass pipe 9. With the movement of the valve body in the opening direction, the valve body 12 increases the air flow of intake air in the bypass pipe 9. As a result, in the range of lower or lighter loads, wherein it is not required for the engine E to be supercharged with a high pressure of intake air, the whole part of, or a large part of, intake air introduced into the intake pipe 5 is directed to the respective cylinders E2 through the bypass pipe 9. Accordingly, the supercharger 3 is subjected only to a lower or lighter load, and hence, causes a decrease in driving loss. When the engine E operates in a range of higher or heavier loads, where the throttle valve 3 is in the full throttle position, or fully opened position, or in larger opening positions, and creates a lower negative pressure P2 in the pressure chamber 11' of the valve housing 11 of the pneumatic valve assembly 10, the valve body 12 of the pneumatic valve assembly 10 is forced mainly by the compression coil spring 19 to move closer to the outlet port 11*b* in the closing direction. With the movement of the valve body 12 to the outlet port 11*b*, the air flow of intake air in the bypass pipe 9 is reduced. When the negative pressure P2 is sufficiently low, the valve body 12 completely closes the outlet port 11*b*, so as to shut down the air flow of intake air in the bypass pipe 9. As a result, in the range of higher or heavier loads, the whole portion of intake air introduced in the intake pipe 5 is compressed by the supercharger 3 and distributed among the respective cylinders E2 of the engine E. As apparent from the above, the valve body 12 is operated to open and close the outlet port 11*b* of the pressure chamber 11' located in the bypass pipe 9, depending only upon increases in negative pressure P2 in the pressure chamber 11', which are substantially proportional to the opening of the throttle valve 2, and without being affected by the supercharger pressure of intake air compressed by the supercharger 3.

The valve body 12 is controlled to open and close the bypass pipe 9 in precise response to the opening and closing motion of the throttle valve 2. Opening and closing of the bypass pipe 9, therefore, is not affected by changes in pressure of the intake air in the intake pipe 5 caused by opening and closing of the valve body 12. Furthermore, in comparison with a conventional pneumatic actuator, which is provided not only with a spring that is sufficiently strong so as to urge the valve in the closing direction, but also with a diaphragm having a large pressure receiving area, due to the fact that supercharger pressure acts on the valve only in the opening direction, the pneumatic valve body 10, according to the present invention, allows the usage of a weaker spring and a smaller diaphragm area in the pneumatic actuator 13.

Figure 2:
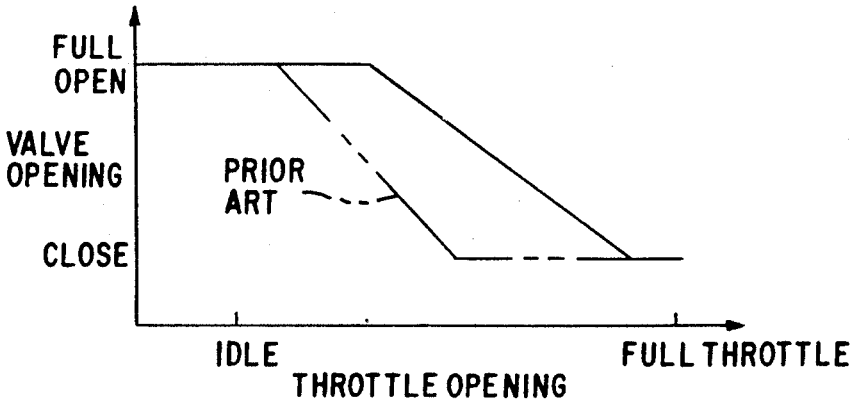
FIG. 2 is a diagram showing a relationship between bypass valve opening and throttle valve opening in the intake system of FIG. 1.

As is shown by a solid line in FIG. 2, the weaker the spring 19 is, the wider the range of opening of the throttle valve 3, in which the valve 12 is maintained at its full operated position, becomes. Accordingly, in a mid-range of engine loads, or of openings of the throttle valve 2, the valve body 12 is prevented from closing unnecessarily, compared to the conventional valve body, which has a valve which opens as is shown by a double dotted line in FIG. 2. This causes a decrease in driving loss in or load on the supercharger 4.

Figure 3A:
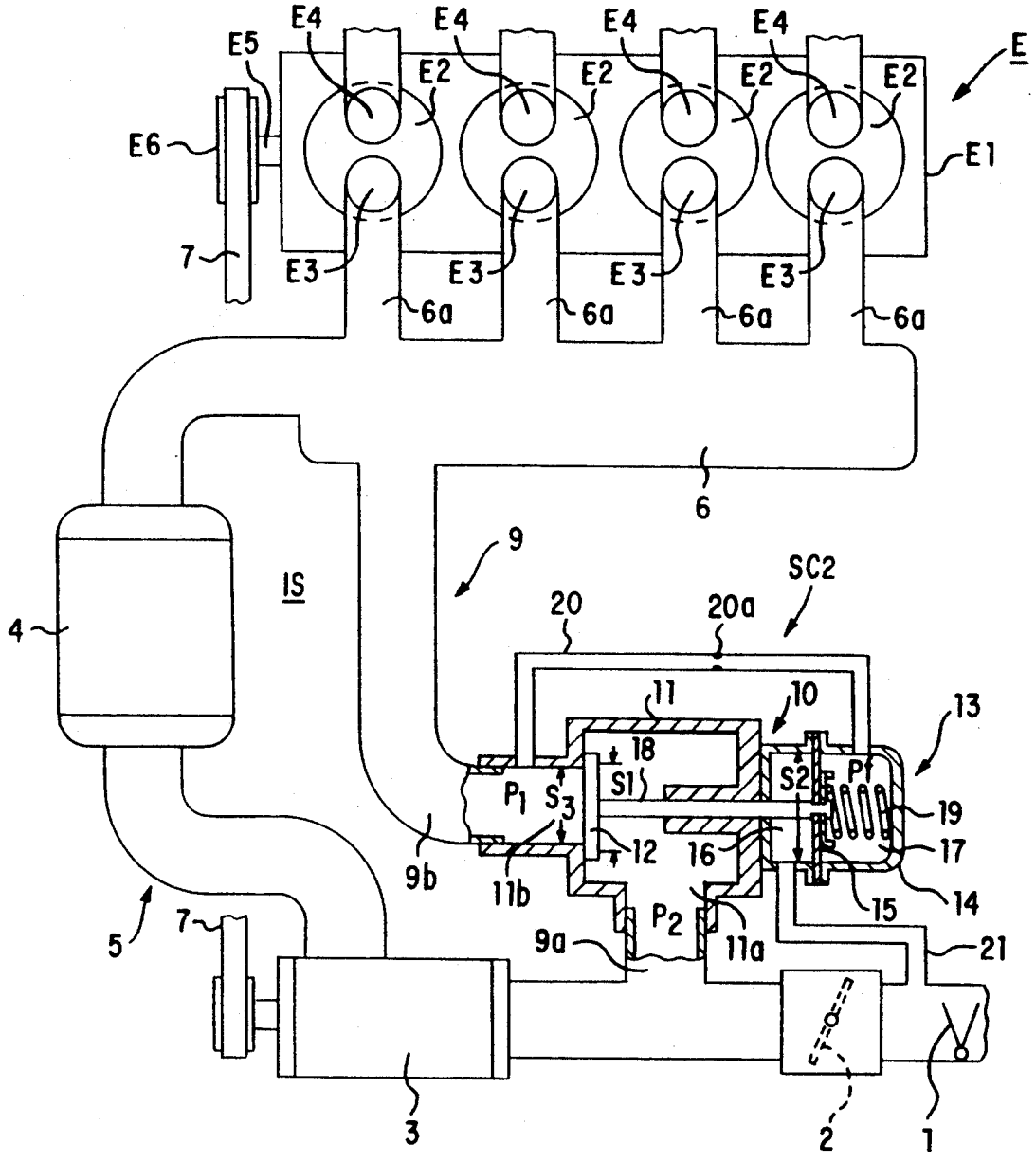
FIGS. 3A and 3B are schematic illustrations showing intake systems in accordance with other preferred embodiments of the present invention.
Figure 3B:
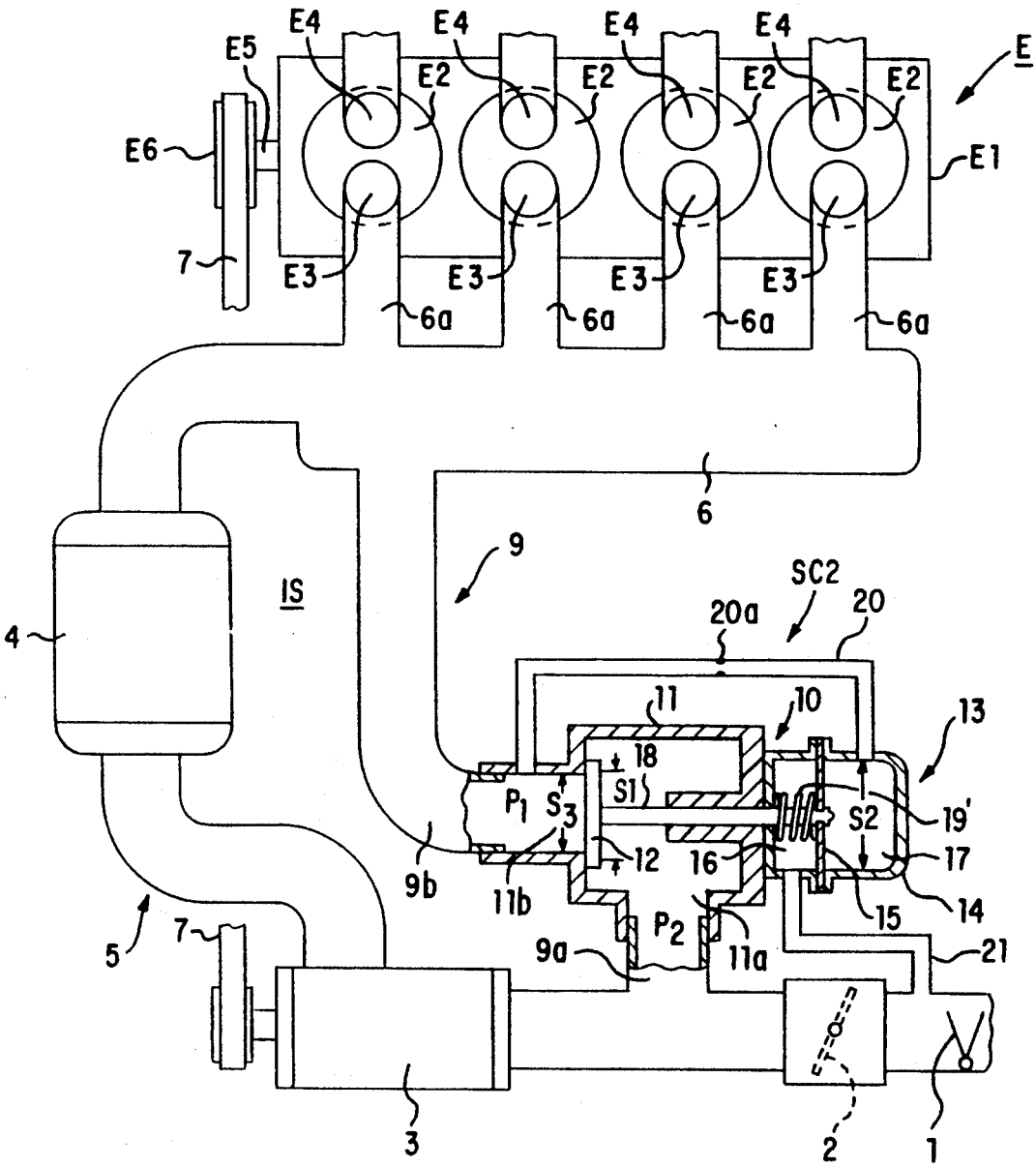

Referring to FIGS. 3A and 3B, as noted above, an intake system in accordance with another preferred embodiment of the present invention is shown, including pneumatic, or pressure controlled, valve means SC2 as a variant of the pneumatic valve means SC1 of FIG. 1. The pneumatic valve means SC2 comprises a pneumatic valve assembly 10 having a rectangular parallelepiped or cylindrical valve housing 11 formed with an upstream, or inlet, port 11*a* and a downstream, or outlet, port 11*b* having a cross-sectional area S3. Both ports 11*a* and 11*b* are cylindrical and have longitudinal center axes intersecting each other at a right angle. A valve body 12, having a pressure receiving area S1 larger than the cross-sectional area S3 of the outlet port 11*b*, is coaxially movable in opposite directions in which the valve body 12 moves closer to and away from the outlet port 11*b*. The pneumatic valve means SC2 further comprises a pneumatic actuator 13 having a rectangular parallelepiped or cylindrical housing 14, the inside of which is divided by a restorable diaphragm 15 into two, i.e., first and second, pressure chambers 16 and 17, airtightly isolated from each other. The first pressure chamber 16, although it may open to the atmosphere, is preferably communicated with the intake pipe 5 upstream of the throttle body 2 by way of a communication pipe 21, so as to introduce therein negative pressure created by intake air introduced in the intake pipe 5 immediately before the throttle valve 3. If the first pressure chamber 16 opens to atmosphere, the valve body 12 is moved away from the outlet port 11*b* of the valve housing 11, or in a direction in which it opens the bypass passage 9 (which direction is hereinafter referred to as an "opening direction"). This is because pressure in the intake pipe 5, before and after the throttle valve 3, tends to be negative with respect to atmosphere when the throttle valve 3 is in the full throttle position or in a near full throttle position. Such a negative pressure is introduced into the valve housing 11 of the pneumatic valve assembly 10 and acts on the valve body 12 so as to move it in the opening direction. However, because of the fact that the communication pipe 21 communicates the first pressure chamber 16 with the intake pipe 5 upstream of the throttle body 2, a negative pressure in the intake pipe 5 is introduced into the first pressure chamber 16 of the pneumatic actuator 13. As a result, the retractable diaphragm 15, connected to the valve body 12 through the valve stem 18, is deflected or deformed so as to move the valve body 12 in a direction in which the valve body 12 opens the bypass passage 9 (which direction is hereinafter referred to as a "closing direction") when the negative pressure is created by the throttle valve 3 in its fully opened position.

Restorable diaphragm 15 has a substantial pressure-receiving area S2 as large as the pressure receiving area S1 of the valve body 12. As long as the valve body 12 closes the outlet port 11*b* of the valve housing 11, compressed, supercharger pressure P1, introduced into the outlet port 11*b* through the downstream pipe segment 9*b* of the bypass pipe 9, acts on the valve body 12 in a area corresponding to, or defined by, the cross-sectional area S3 of the outlet port 11*b* of the pneumatic valve assembly 10. Pressure P1', which is generally equal to the supercharger pressure P1, is introduced, or transmitted, into the second pressure chamber 17 of the pneumatic actuator 13 from the outlet port 11*b* through the communication pipe 20, and acts on the whole area S2 of the restorable diaphragm 15. Accordingly, when the supercharger pressure P1 and the pressure P1' are equal to each other, the valve body 12 receives an axial force smaller in the opening direction than in the closing direction.

Typically, due to the fact that the supercharger pressure introduced into the outlet port 11*b* through the downstream pipe segment 9*b* of the bypass pipe 9 accompanies pulsations, and to the fact that the restorable diaphragm 15 receives the pressure P1', introduced or transmitted into the second pressure chamber 17 of the pneumatic actuator 13 from the outlet port 11*b* of the pneumatic valve assembly 10 through the communication pipe 20, the transmitted pressure P1' is accompanied by pulsations, but with a phase delay with respect to the pulsations of the supercharger pressure P1. For this reason, there is a chance that the supercharger pressure P1 acting directly on the valve body 12 will occasionally become higher than the pressure P1' acting on the valve body 12 through the restorable diaphragm 15. However, the valve body 12, when closing the outlet port 11*b*, receives the supercharger pressure P1 in an area equal to the cross-sectional area S3 of the outlet port 11*b*, which is smaller than the pressure receiving area S2 of the restorable diaphragm 15, and, therefore, is always subjected to a force larger in the opening direction than in the closing direction. This prevents the valve body 12, when in the closed position, from being adversely affected by the pulsations of the supercharger pressure P in the outlet port 11*b*. As a result, the valve body 12 operates precisely according to changes in negative pressure P2 developed in the pressure chamber 11*a* of the valve assembly 10 by the intake air introduced in the intake pipe 5 while it opens.

In order to eliminate more effectively the adverse effects of pulsations to the valve body 12 of the pneumatic valve assembly 10, an orifice 20*a* is desirably provided in the communication pipe 20 between the downstream port 11*b* of the pneumatic valve assembly 10 and the second pressure chamber 17 of the pneumatic actuator 13.

Figure 4:
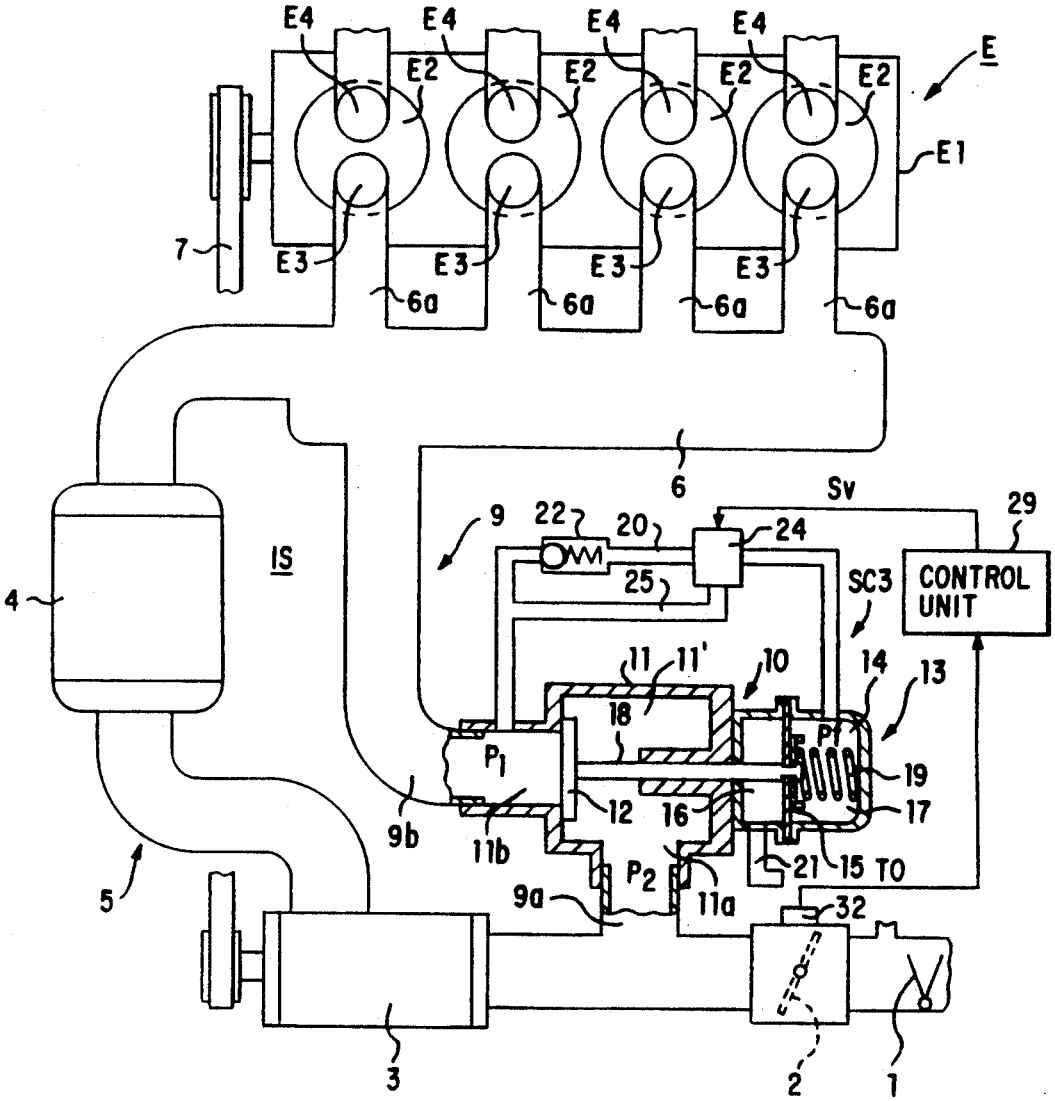
FIG. 4 is a schematic illustration showing an intake system in accordance with still another preferred embodiment of the present invention.

Referring to FIG. 4, an intake system in accordance with another preferred embodiment of the present invention is shown, and includes pneumatic, or pressure operated valve means SC3 as a variant of the pneumatic valve means SC1 of FIG. 1 that comprises a pneumatic valve assembly 10 and a pneumatic actuator 13, both of which are basically the same in structure and operation as those of the pneumatic valve means SC1 of FIG. 1.

A communication pipe 20 is disposed between the downstream port 11*b* of the pneumatic valve body 10 and the second pressure chamber 17 of the pneumatic actuator 13 and communicates them with each other. A check valve 22 is provided in the communication pipe 20 so as to open and close or shut it only when the supercharger pressure P1 introduced into the outlet port 11*b* through the downstream pipe segment 9*b* of the bypass pipe 9 is higher than the pressure P1' in the second pressure chamber 17 of the pneumatic actuator 13. The communication pipe 20 is further provided with a three way valve, such as a three way solenoid valve 24, connected between the check valve 22 and the second pressure chamber 17 of the pneumatic actuator 13. The three way solenoid valve 24 is connected to the outlet port 11*b* of the pneumatic valve assembly 10 by way of a supplementary, or bypass, communication pipe 25.

The intake system includes a control unit 29, basically comprising a general purpose microcomputer, which receives an electric signal TO representative of the opening, or operated throttle position, of the throttle valve 3, provided from a throttle opening sensor 32, well known in the art, and outputs, in response to the electric signal, a control signal Sv to the three way solenoid valve 24. In particular, the control unit 28, when receiving an electric signal TO representative of an opening of the throttle valve 3 larger than a predetermined critical opening to which the throttle valve 3 opens when the engine E operates at higher or heavier loads, causes the three way solenoid valve 24 to close or shut the bypass communication pipe 25. The control unit 29, on the other hand, causes the three way solenoid valve 24 to open the bypass communication pipe 25 when an engine load becomes lower or lighter than a predetermined specific value that is detected, as a specific opening angle $\theta 1$ of the throttle valve 3 which is slightly smaller than the full throttle of the throttle valve 3, by the throttle opening sensor 32.

While the engine E operates at lower, i.e., lighter, or moderate loads, the valve body 12 of the pneumatic valve assembly 10 is continuously open so as to open the outlet port 11*b* of the pneumatic valve assembly 10 and thereby to communicate the upstream and downstream pipe segments 9*a* and 9*b* of the bypass pipe 9 with each other. The three way solenoid valve 24 is opened to communicate the bypass communication pipe 25 with the communication pipe 20 between the check valve 22 and the second pressure chamber 17 of the pneumatic actuator 13. Accordingly, the valve body 12 of the pneumatic valve assembly 10, when the engine E operates at lower or moderate loads, is operated to open and close the outlet port 11*b* of the pneumatic valve assembly 10 according to changes in negative pressure P2 in the pressure chamber 11′ of the pneumatic valve assembly 10.

When the throttle opening sensor 32 detects openings of the throttle valve 3 larger than the specific opening angle $\theta 1$, the control unit 29 causes the three way solenoid valve 24 to close so as to close or shut down the transmission of pressure in the bypass communication pipe 25, so that the supercharger pressure P1 in the outlet port 11*b*, if higher than the pressure in the second pressure chamber 17 of the pneumatic actuator 13, is introduced, or transmitted, into the second pressure chamber 17 of the pneumatic actuator 13 through the check valve 22. Accordingly, if the supercharger pressure P1 in the outlet port 11*b* accompanies pulsations, a maximum pressure of the supercharger pressure P1 is stored as a pressure P″ in the second pressure chamber 17 of the pneumatic actuator 13.

Figure 5:
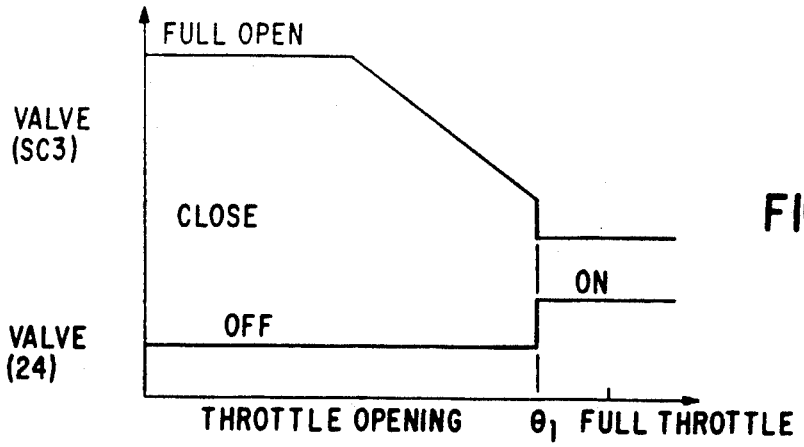
FIG. 5 is a diagram showing a relationship between a bypass valve opening, a three way valve operation, and a throttle valve opening in the intake system of FIG. 4.

The intake system IS shown in FIG. 4, in a range of higher, or heavier, engine loads, does not provide a force that is larger in the opening direction than in the closing direction, so that the valve body 12 of the pneumatic valve assembly 10 closes the outlet port 11*b* with certainty and thereby shuts down the transmission of pressure in the bypass pipe 9, in spite of pulsations of the supercharger pressure P1 in the downstream pipe segment 9*b* of the bypass pipe 9 while the engine E operates at higher, or heavier, engine loads, as is shown in FIG. 5.

It is apparent to those skilled in the art that the electric signal TO may be replaced with a signal representative of a compressed pressure in the surge tank which is larger than a predetermined critical pressure to which the compressed intake air raises when the engine E operates at higher or heavier loads. Such a pressure may be detected by any well known pressure sensor.

Figure 6:
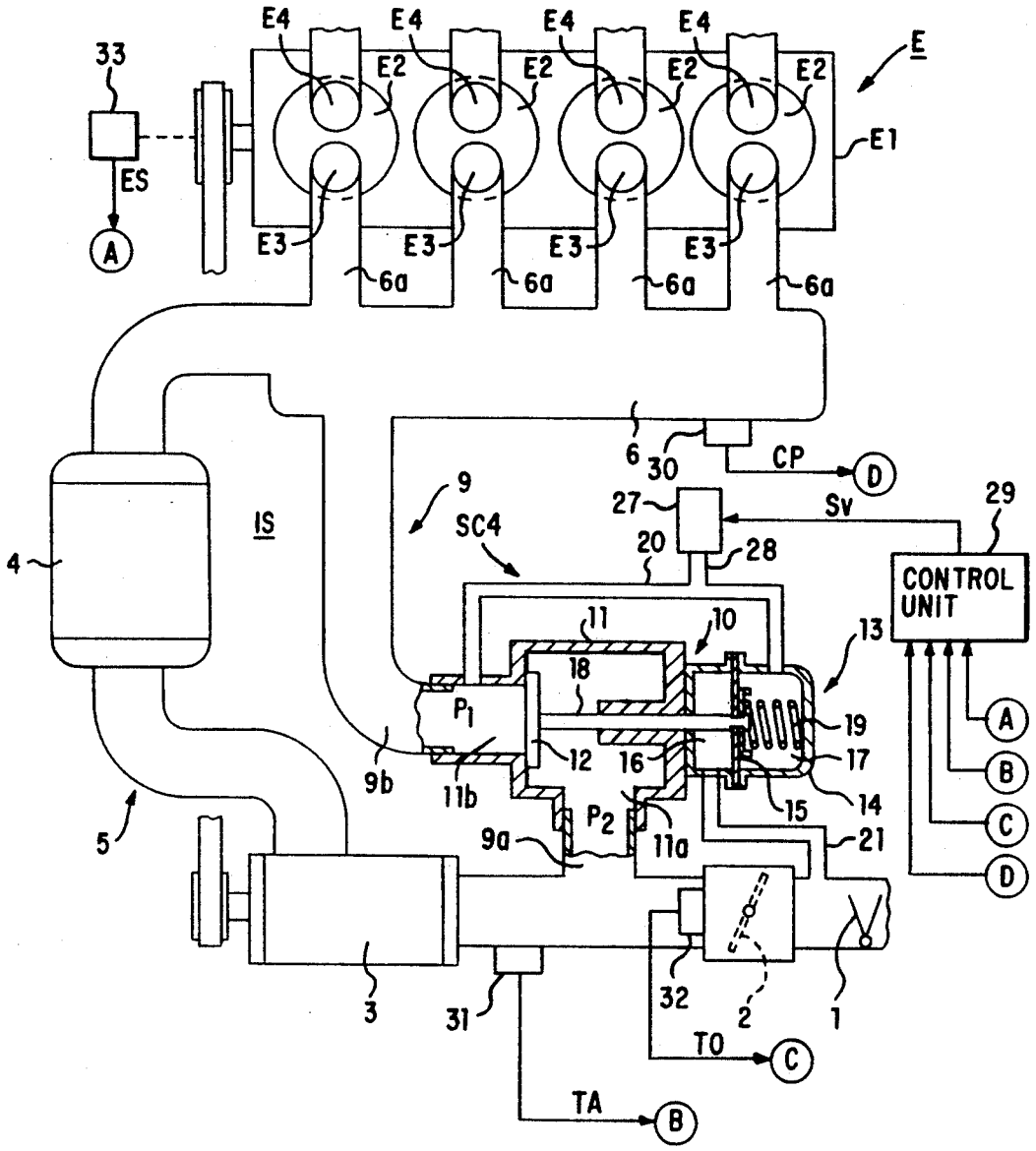
FIG. 6 is a schematic illustration showing an intake system in accordance with a further preferred embodiment of the present invention.

Referring to FIG. 6, an intake system IS in accordance with a further preferred embodiment of the present invention is shown, including pneumatic, or pressure operated, valve means SC4 as another variant of the pneumatic valve means SC1 of FIG. 1. The pneumatic valve means SC4 comprises a pneumatic valve assembly 10 and a pneumatic actuator 13 which, themselves, are the same in structure and operation as those of the pneumatic valve means SC1 of FIG. 1.

A communication pipe 20 is disposed between the downstream port 11*b* of the pneumatic valve body 10 and the second pressure chamber 17 of the pneumatic actuator 13, and communicates them with each other. A relief valve 27 is connected to the communication pipe 20 through a pipe segment 28 so as to open and close, or vary, the cross-sectional area of the communication pipe 20 according to at least one of signals CP and TA, representative of an unusual or unexpected rise in compressed pressure and an unusual or unexpected rise in intake air temperature, respectively, from a control unit 29, which basically comprises a general purpose microcomputer. These rises in pressure and temperature can be detected by sensors 30 and 31, well known to those skilled in the art. The relief valve 27, when opening partly or fully, discharges, or relieves pressure in the communication pipe 20 so as to drop the pressure in the outlet port 11*b* of the-pneumatic valve assembly 10.

The control unit 29, when receiving the signals CP and TA from the limit sensors 30 and 31, outputs a control signal Sv in response and sends it to the relief valve 27 so as to cause it to open, thereby discharging, or relieving, the pressure in the communication pipe 20 and dropping the supercharger pressure P1 in the downstream pipe segment 9*b* of the bypass pipe 9.

Figure 7A:
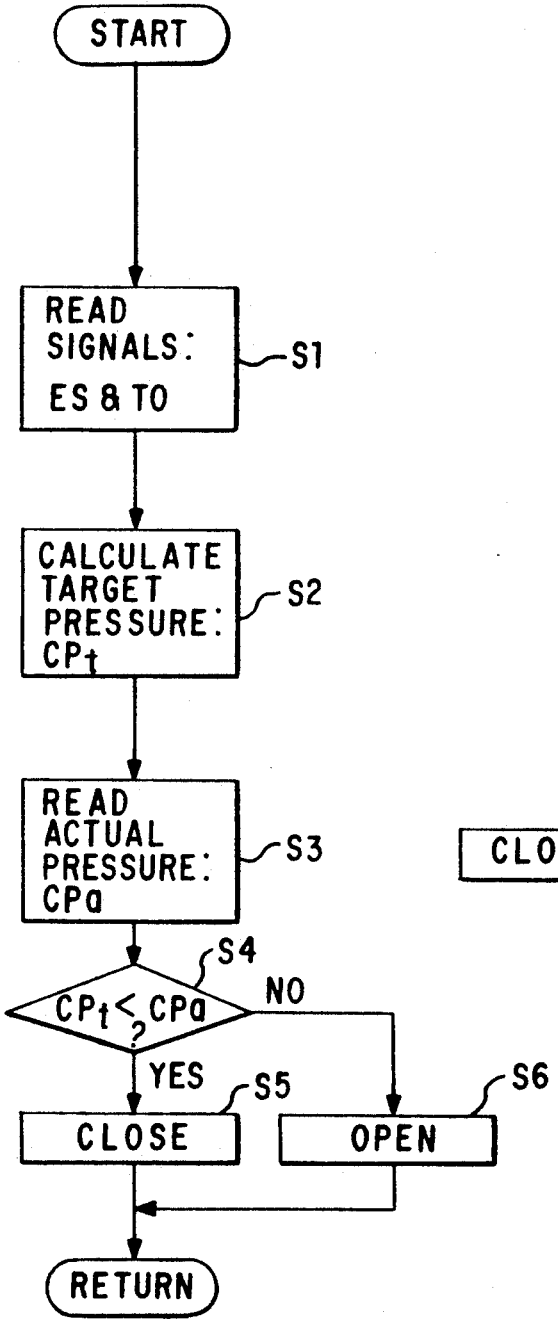
FIGS. 7A and 7B are flow charts illustrating bypass valve control routines.
Figure 7B:
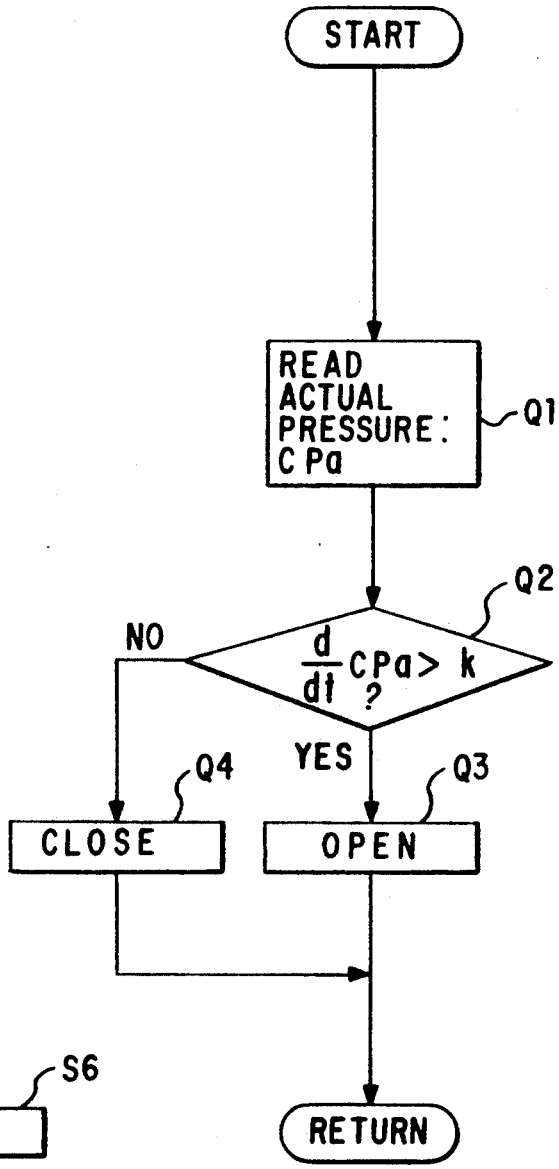

The operation of the intake system depicted in FIG. 6 is best understood by reviewing FIGS. 7A and 7B, which are flow charts illustrating routines for the microcomputer of the control unit 29. Programming a computer is a skill well understood in the art. The following description is written to enable a programmer having ordinary skill in the art to prepare an appropriate program for the microcomputer of the control unit 29. The particular details of any such program would, of course, depend upon the architecture of the particular computer selected.

Referring now to FIG. 7A, which is a flow chart of a supercharger pressure relief control routine for the microcomputer of the control unit 29, the first step is to read outputs ES and TO from the engine speed sensor 33 and the throttle opening sensor 32, respectively, to determine the operating condition of the engine E, such as an operating engine speed of the engine E and an operated opening of the throttle valve 3, at step S1. Based on the operating condition thus determined, a target or desired supercharger pressure CPt is calculated or read from a map, previously given in the terms of the correlation between engine operating condition and target supercharger pressure, at step S2. The map data is stored in the microcomputer of the control unit 29. Then, the control unit 29 reads a signal CP from the pressure sensor 30 to determine a supercharger pressure CPa actually delivered into the surge tank 6, at step S3. At step S4, a decision is made whether the actual supercharger pressure CPa is equal to or lower than the target supercharger pressure CPt. If the answer to the decision at step S4 is "yes, this indicates that the actual supercharger pressure CPa is equal to or lower than the target supercharger pressure CPt, and the control unit 29 does not output a signal Sv. As a result, the relief valve 27 is still closed to close or shut down the communication pipe 20 so as to maintain the supercharger pressure in the communication pipe 20. Accordingly, the supercharger pressure in the surge tank 6 is controlled by the movement of the valve body 12 of the pneumatic valve means SC4.

If the answer to the decision at step S4 is "no," this indicates that the actual supercharge pressure CPa is higher than the target supercharge pressure CPt, and the control unit 29 outputs and sends a signal Sv to the relief valve 27 so as to open the relief valve 27 and thereby to relieve, or discharge, and drop the supercharger pressure in the downstream pipe segment 9*b* of the bypass pipe 9. This results in a decrease in supercharger pressure in the surge tank 6. The routine from steps S1 through S6 is repeated on a controlled short cycle.

Referring to FIG. 7B, which is a flow chart of a supercharger pressure relief control routine for the microcomputer of the control unit 29, after reading a signal CP from the pressure sensor 30 to determine a supercharger pressure CPa actually delivered into the surge tank 6 at step Q1, the control unit 29 automatically calculates the raising rate d/dt(CPa) of supercharger pressure based on the change of the signal CP in a well known manner and makes a decision, at step Q2, as to whether the raising rate d/dt(CPa) is larger than a predetermined specific rate k. If the answer to the decision at Q2 is "yes," the control unit 29 outputs and sends a signal SV to the relief valve 27, at step Q3, so as to open the relief valve 27 and thereby to relieve, or discharge, and drop the unusually raised supercharger pressure CPa in the surge tank 6.

If the answer to the decision at step Q2 is "no," this indicates that the actual supercharger pressure CPa is ordinarily controlled. The control unit 29 removes a signal Sv, at step Q4, so as to close the relief valve 27, if open, or maintain the relief valve 27 closed. The routine from steps Q1 through Q4 is repeated at properly controlled intervals.

It is to be understood that although the invention has been described in detail with respect to preferred embodiments thereof, various other embodiments and variants are possible which fall within the scope and spirit of the invention, and such embodiments and variants are intended to be covered by the following claims.

What is claimed is:

1. An intake system including an intake passage provided with a throttle valve and a supercharger, in order, from an upstream side of the intake passage, for delivering intake air having a supercharged pressure created by the supercharger into cylinders of an internal combustion engine, said intake system comprising:

a bypass passage branching off from the intake passage between the throttle valve and the supercharger and connected to the intake passage downstream of the supercharger for permitting an intake air flow therein to bypass the supercharger; and pressure controlled valve means disposed in said bypass passage for causing and shutting off said intake air flow in said bypass passage, said pressure controlled valve means including a pressure operated actuator having a first pressure chamber, a second pressure chamber, and a communication pipe connecting a portion of said bypass passage downstream of said pressure controlled valve means with said second pressure chamber, said pressure controlled valve means including a valve receiving, in one direction, the supercharged pressure in said intake passage downstream of the supercharger from said portion of said bypass passage downstream of said pressure controlled valve means and a negative pressure created by the intake air flow in the intake passage between the throttle valve and the supercharger from a portion of said bypass passage upstream of said pressure controlled valve means so as to allow said intake air flow and, in another direction opposite to said one direction, a pressure from said communication pipe and said second pressure chamber which is substantially equal to the supercharged pressure so as to shut down said intake air flow, thereby regulating the amount of intake air flowing in said bypass passage, depending upon said negative pressure, so as to control the supercharged intake air pressure, said pressure controlled valve means further including a valve housing forming therein a pressure chamber and supporting said valve in said pressure chamber for linear movement, which valve housing has an inlet port for introducing said negative pressure into said pressure chamber so as to apply it to said valve and an outlet port for introducing said supercharged pressure so as to apply it to said valve, said pressure operated actuator introducing said pressure which is substantially equal to the supercharged pressure to the valve in the other direction and including an actuator housing secured to said valve housing and forming therein said second pressure chamber, and diaphragm means disposed in said actuator housing and operationally coupled to said valve for receiving and applying said pressure from said communication pipe to said valve in the other direction, said diaphragm means comprising a restorable diaphragm connection to said valve and urging means for deflecting said restorable diaphragm in the other direction, said restorable diaphragm forming said first pressure chamber and said second pressure chamber so that they are air-tightly isolated from each other, the second pressure chamber being in communication with said outlet port, the first pressure chamber being in communication with said intake passage upstream of said throttle valve, said urging means being disposed in at least one of said first pressure chamber and said second pressure chamber.

2. An intake system as recited in claim 1, wherein said urging means comprises a compression coil spring disposed in said second pressure chamber.

3. An intake system as recited in claim 1, wherein said urging means comprises an expanded tension coil spring disposed in said first pressure chamber.

4. An intake system as recited in claim 1, wherein said actuator means further comprises a check valve disposed in said communication pipe for opening said communication pipe only when said supercharged pressure is higher than said pressure from said communication pipe.

5. An intake system as recited in claim 4, wherein said actuator means further comprises a bypass communication passage branching off from said communication pipe upstream of said check valve and connected to said communication pipe downstream of said check valve and a three way valve disposed between said bypass communication pipe and said communication passage downstream of said check valve.

6. An intake system as recited in claim 5, wherein said three way valve comprises a three way solenoid valve.

7. An intake system as recited in claim 1, wherein said actuator means further comprises a relief valve disposed in said communication pipe for relieving a pressure in said communication pipe when said intake air in said intake passage downstream of the supercharger is extraordinarily controlled.

8. An intake system as recited in claim 7, wherein said relief valve relieves a pressure in said communication pipe when said intake air in said intake passage downstream of the supercharger causes a rise in temperature larger than a predetermined specific rise.

9. An intake system as recited in claim 7, wherein said relief valve relieves a pressure in said communication pipe when said intake air in said intake passage downstream of the supercharger causes a rise in pressure larger than a predetermined specific rise.

10. An intake system as recited in claim 1, wherein said supercharger is a mechanical type supercharger operationally coupled to said internal combustion engine.

* * * * *